US005870776A

United States Patent [19]

Blackman

[11] Patent Number: 5,870,776

[45] Date of Patent: Feb. 16, 1999

[54] FUSED NECKTIES AND METHOD

[76] Inventor: Arthur B. Blackman, 3401 N. I St., Philadelphia, Pa. 19134

[21] Appl. No.: 806,209

[22] Filed: Feb. 26, 1997

[51] Int. Cl.[6] ..... A41D 25/00; A41D 25/16

[52] U.S. Cl. ..... 2/144; 2/146; 2/243.1

[58] Field of Search ..... 2/144, 145, 146, 2/147, 148, 149, 150, 151, 152.1, 153, 154, 155, 156, 157, 158, 159, 52, 338, 311, 312, 300, 243.1

[56] References Cited

U.S. PATENT DOCUMENTS

| | | | |
|---|---|---|---|
| 3,426,360 | 2/1969 | Ackerman | 2/146 |
| 3,562,814 | 2/1971 | Ackerman | 2/146 |
| 3,755,821 | 9/1973 | Tellone | 2/153 |
| 4,229,834 | 10/1980 | Alexander et al. | 2/146 |
| 4,506,389 | 3/1985 | Franklin | 2/146 |
| 4,943,239 | 7/1990 | Fini | 2/146 |
| 5,406,646 | 4/1995 | Ballit et al. | 2/243.1 |
| 5,432,952 | 7/1995 | Tate | 2/49.4 |
| 5,463,779 | 11/1995 | Pinkus | 2/146 |

FOREIGN PATENT DOCUMENTS

| | | | |
|---|---|---|---|
| 2143559 | 3/1972 | Germany | 2/144 |

*Primary Examiner*—Jeanette Chapman
*Attorney, Agent, or Firm*—Finnegan, Henderson, Farabow, Garrett & Dunner, L.L.P.; Scott H. Blackman

[57] ABSTRACT

The present invention provides an improved, more efficient method of constructing neckties, as well as the resulting neckties, by laminating one or more of the components. The invention thus reduces the number of steps or components necessary to construct a necktie.

3 Claims, 4 Drawing Sheets

FUSED NECKTIES AND METHOD

FIELD OF THE INVENTION

The present invention relates to efficient construction of neckties. More particularly, the present invention provides a method and structure that reduces the construction costs of neckties.

BACKGROUND

Traditionally, neckties, both standard (club) and pre-folded (clip-on) versions, are manufactured using three distinctly different, separate fabric components: the shell; an interlining; and the lining used in the tips. The shell fabric is the patterned material intended to be visible when the necktie is being worn. The interlining provides shape, body and stability to the necktie. The lining used in the tips, or the tipping material, is generally a lighter fabric which is used to bind the ends of the shell around the interlining.

The shell fabric provides the color and pattern for the tie. It can be made of almost any material including, for example, polyester, silk, wool, or blends of these materials. Historically, limitations regarding choice of shell fabric were mainly considerations of sufficient strength, durability, finished appearance, and a lack of a tendency to fray upon cutting of the material. The shell of a necktie is typically (but not necessarily) made from three pieces—the broad end, the narrow end and a middle piece—that are sewn together end-to-end, alternating the bias of the material, to form the complete shell. The multi-piece, alternate-bias construction helps minimize the potential for twisting of the necktie material.

The interlining serves as the structural "backbone" of the product. It typically has been made of wool or wool blends, woven or knitted. An interlining may be formed from more than one interliner ply placed on top of one another and usually stitched or tacked to each other.

The tipping material is visible from the back, or bottom, of a finished product. It is typically made of acetate or polyester taffeta. In a standard necktie, for example, there is usually one piece of tipping at the broad end of the tie, and one piece of tipping at the narrow end of the tie, each tipping closing off the respective end of the tie.

When the necktie is fully assembled, the interlining is hidden by the shell and the tipping material, which together form a complete cover over the interlining. The tipping closes the ends of the completed tie, giving it a finished look and keeping the interlining from being exposed or from sliding out if the stitch holding the interlining to the underside of the shell fabric were to break.

During the typical process of constructing a necktie in this manner, the three components are separately spread and cut from bulk goods to a pre-determined size and shape. For example, six interlinings may be cut simultaneously from a piece of fabric, using a single template for six identical pieces placed across the fabric. Similarly, shells and tipping are spread and cut. Then, the interlining for a single tie is carefully stitched or tacked in place to the assembled shell for the same tie. If the interlining is more than one ply, sometimes those plies would separately be tacked or stitched together before the interlining is connected to the shell. The tipping material for that tie is then stitched to the shell, enclosing the interlining and closing the ends of the tie to give the tie a finished look, and to keep the interlining in place even if the interlining stitch breaks. The shape of the finished tie generally matches the shape of the interlining.

The interlining provides the body and support for a standard tie to return to its original shape again and again, after each time it is used by being tied and then later untied.

Fusing has been used in the manufacture of articles of clothing for over twenty five years. Traditionally, parts that are fused are cut separately from the actual fusible material. Then, these parts are fused, or laminated, with a fusing press, resulting in a single unit. Fusing has typically been used in many parts of clothing, such as collars, cuffs, fronts, and pockets. In fact, almost all aspects or parts of clothing have used fused goods when particular body is desired for that piece of the finished product. Typically, parts of clothing which are desired to drape, rather than to have body or structure, have not been subject to fusing. Examples of such parts are sleeves and backs of clothing.

Lamination (though not fusing) could also refer to a similar process that involves only one ply of material, rather than two or more plies being overlayed and affixed. In that situation, one ply of material could be laminated by itself, coating the material completely or even coating the material with sporadic laminate, possibly in a pattern such as strips of laminate running across the material, often diagonally across the material's warp construction (i.e., the length of the fabric's construction).

But fusing and lamination had never been used in neckties. While fusing has been used, for example, in formal wear pre-knotted bow ties, such bow ties typically do not have an interlining and are constructed differently than standard or pre-folded neckties. In standard and pre-folded neckties, fusing and lamination has not been used, despite the fact that more efficient constructions are always desired in this particularly cost-conscious industry that is moving overseas more and more because of decreased labor and production costs in foreign countries.

The instant invention provides use of fusing in the construction of neckties, resulting in an easier and more economical construction of the finished product.

DESCRIPTION OF RELATED ART

Various attempts have been made to improve the characteristics of neckties by incorporating linings of various types. For example, Ackerman U.S. Pat. Nos. 3,426,360 and 3,562,814 disclose a necktie having a double-ply lining, with the plies being overlaid and secured together in order to maintain their positions relative to each other, prior to securing the two plies to the tie casing.

Alexander et al. U.S. Pat. No. 4,229,834 discloses neckwear having a fabric casing folded longitudinally and a highly resilient single lining fabricated of double woven material. The interwoven double-cloth fabric lining is made of two overlaid plies of plain woven fabric with a binder thread engaging the two plies.

Pinkus U.S. Pat. No. 5,463,779 discloses an interlining of multiple plies joined by stitching as roll goods before die cutting the stitched-together fabric before sewing the interlinings into neckwear.

Tate U.S. Pat. No. 5,432,952 discloses a compound bib having two bib members, one for protecting from spill soilage the exterior surface of garments at the bib wearer's chest and the other for protecting the chest and front neck area under surface of the garments. Tate discloses that the bib members may be a laminate of a liquid absorbent outer layer and a liquid impermeable inner layer.

None of the foregoing discuss or suggest the use of fusing or lamination in constructing neckties. There remains a need for more efficient necktie construction.

SUMMARY OF THE INVENTION

Accordingly, the present invention is directed to an improved, more efficient method of construction and construction for neckties using fusing or lamination to replace stitching, tacking or other traditional methods of attachment. This results in fewer steps, and potentially requires manipulation of fewer pieces of material, during the construction of a standard or pre-folded necktie.

Additional objects and advantages of the invention will be set forth in part in the description which follows, and in part will be obvious from the description, or may be learned by practice of the invention. The objects and advantages of the invention will be realized and attained by the method and construction particularly pointed out in the written description and appended claims as well as the appended drawings.

To achieve these and other advantages and in accordance with the purpose of the invention as embodied and broadly described, the invention provides neckties in which a single ply of interlining material is fused to the shell fabric during construction of the neckwear but before spreading and cutting of the interlining and shell.

In another aspect, the invention includes the fusion of one or more of any of the components, including the shell, one or more interlining plies, and the tipping material, to any other of the components during the construction of neckties but before one or more of the components to be fused are spread and cut.

In yet another aspect, the invention includes the fusion of one or more of any of the components to any other of the components after one or more of the components to be fused have been spread and cut.

In another aspect, the invention includes the lamination of one or more of any of the component parts, separately from any other component parts, allowing the laminated component part also to serve the purpose of, and to replace, one or more of the other component parts.

Fusing or laminating during the construction of neckties generally involves the fusing of two or more of the component parts that would otherwise normally be attached to each other by traditional means, usually stitching or tacking. In particular, this could involve fusing of the interlining bulk material to the shell bulk material before further processing, including spreading and cutting. This provides distinct advantages, because there would no longer be a need for a separate free floating interlining to be separately cut, installed, and fastened to the inside of the tie.

Fusing or laminating also tends to stabilize the material with regard to potential twisting of parts of the fabric as it is manipulated during use. This provides extra flexibility in choosing appropriate and economical materials and methods of construction previously dependent in part on the need to prevent twisting of the tie. For example, with the instant invention, there are more economical choices for interlining material, which would be more resistant to twisting. Also, the shell may be constructed from one part rather than three, since biasing concerns are minimized.

Lamination could also involve the coating of a single component in order to use the laminated component additionally in the place of at least one other component. For example, a laminated shell might be used without any interlining at all, to serve the additional functions normally served by the interlining.

Use of fusing in the construction of neckties allows a reduction in construction costs by simplifying the steps in putting together the final product. Although use of this procedure may require more of the now-fused interlining, increasing that part of the cost for material, the overall result tends nevertheless to be a savings in the total cost of manufacturing neckties.

Thus, the fusing or laminating process could lower labor costs and save time as follows, for example and without limitation: (1) the spreading and cutting of the shell and interlining can be converted from two separate operations to a single operation; (2) the steps of carefully inserting and stitching the interlining into the tie shell can be eliminated; (3) the amount of material needed for tipping (whose sole function is converted to appearance of the article, rather than enclosing and fastening the interlining) can be reduced; (4) the process of turning the tie (ties are sewn inside out and require a turning process to turn them right side out; this turning is slowed by a separate interlining which may need to be shaped or trimmed during the turning process) can be simplified and shortened; and (5) the necktie can be made out of a larger variety of shell materials, since the fusing or laminating process will eliminate the fraying that may otherwise be problematic in certain fabrics, rendering those fabrics difficult to sue in neckties without use of lamination.

Further, lamination can be used in constructing neckties to further eliminate steps of construction or component parts, and decreasing in whole or part the amount of fabric needed. For example, as discussed above, the shell of a tie could be constructed from one stable part rather than the current standard of three parts.

Further, fusing can be used in constructing neckties in order to improve the hand, tie quality, strength, bulk and body of the finished product.

It is to be understood that both the foregoing general description and the following detailed description are exemplary and explanatory only and are not restrictive of the invention as claimed.

BRIEF DESCRIPTION OF THE DRAWINGS

The accompanying drawings, which are incorporated in and constitute a part of this specification, are included to provide a further understanding of the invention and illustrate one embodiment of the invention and together with the description serve to explain the principles of the invention. In the drawings.

DETAILED DESCRIPTION OF THE INVENTION

Figure 1:
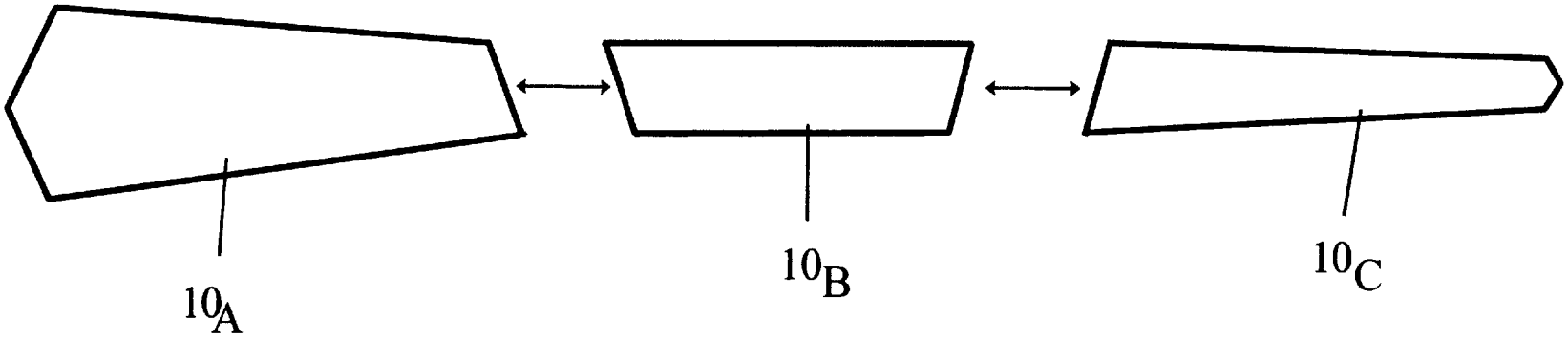
FIG. 1 is a view of a typical three-part shell for a traditional prior art necktie, before the three parts are joined end-to-end.
Figure 2:
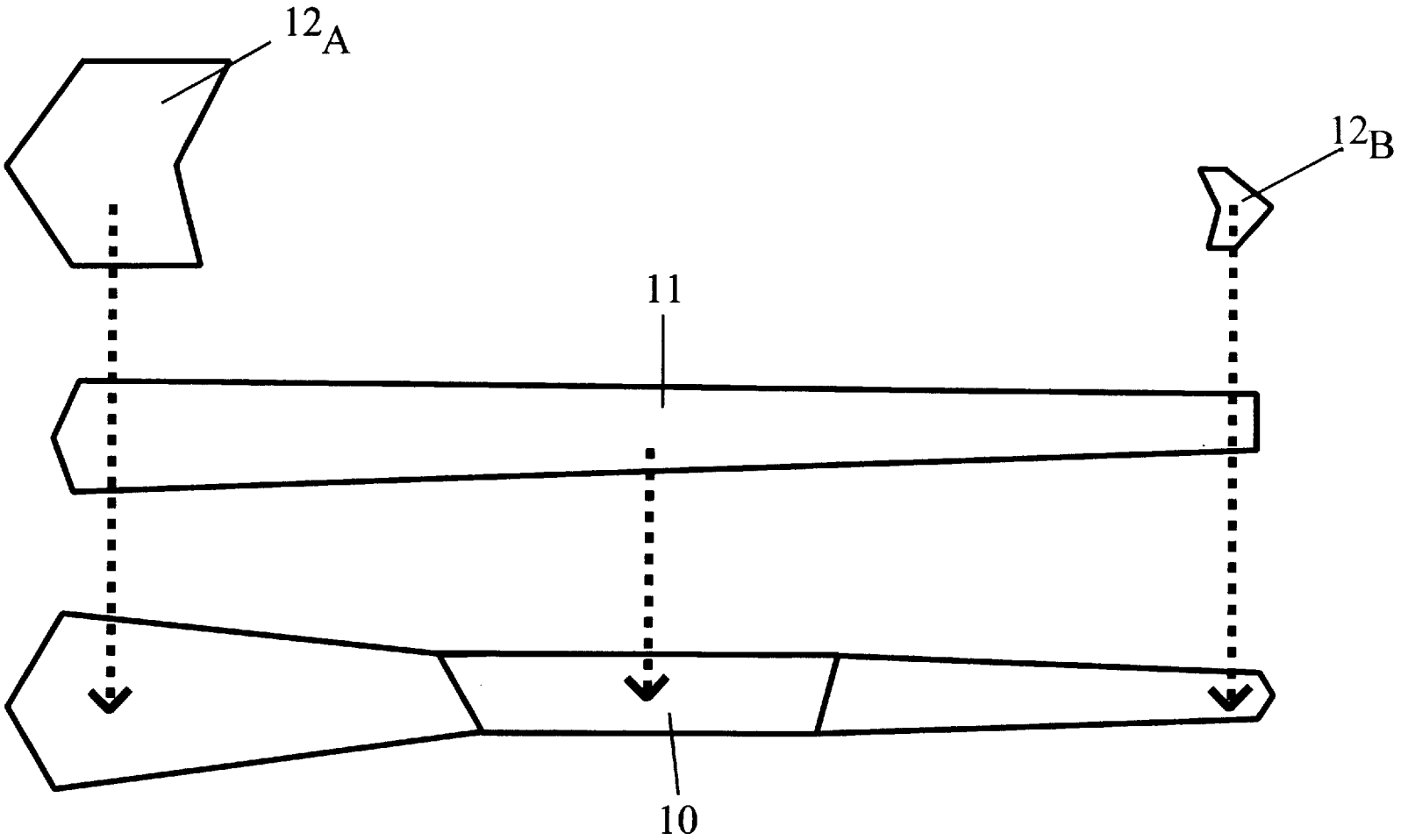
FIG. 2 is a view of the components and assembly of a traditionally-constructed prior art necktie.

As seen in FIG. 1, in constructing a traditional shell for a prior art necktie, the head of the shell ($10_A$) is sewn or otherwise attached to the middle of the shell ($10_B$), which is sewn or attached to the tail of the shell ($10_C$) The three parts together form the shell (10), referred to in FIG. 2. In FIG. 2, the components of a traditional prior art necktie—the assembled shell (10), interlining component (11) and tipping components ($12_A$) and ($12_B$)—were separately prepared from bulk material. The interlining component (11), which itself could be more than one ply (which could be preliminarily affixed to each other), is then inserted carefully and stitched or tacked to the inside of the shell component (10). The tipping components ($\mathbf{12}_A$) and ($\mathbf{12}_B$) are then attached to the ends of the shell (10) to enclose the interlining (11). The product would then be carefully turned right side out, while the interlining (11) is observed and, if necessary, shaped or trimmed.

Figure 3:
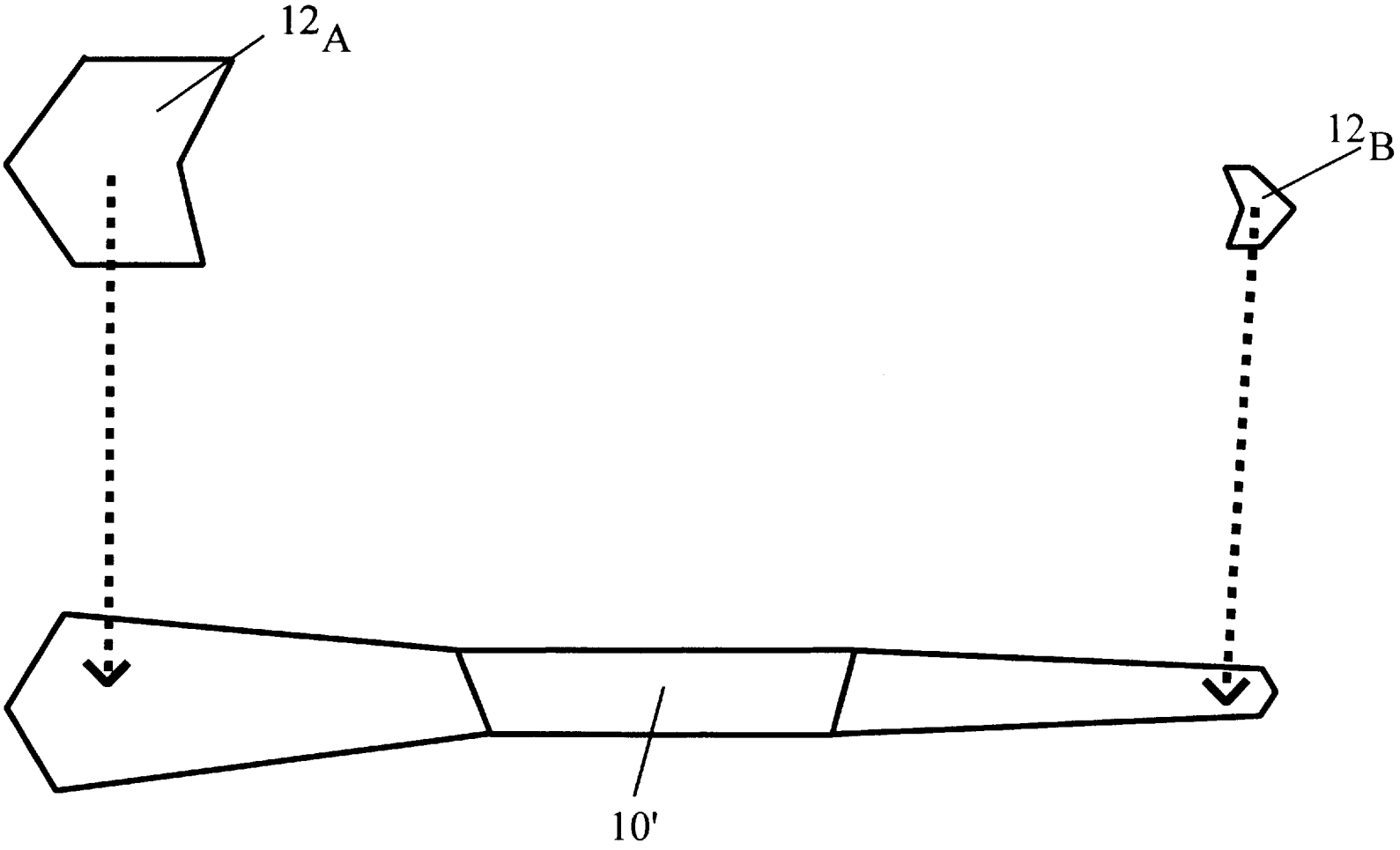
FIG. 3 is a view of the components and assembly of a necktie that embodies the instant invention.

In contrast, in one embodiment of the instant invention, as seen in FIG. 3 and discussed above, the shell component (10') is prepared by cutting and sewing the three shell parts from laminated shell or fused shell/interlining material. Because the shell (10') is a laminated shell or fused shell/interlining, there is no need for a separate interlining (11) as in FIG. 2. The tipping components ($\mathbf{12}_A$) and ($\mathbf{12}_B$) are then attached to the ends of the shell (10'), and the product is turned right side out.

In another embodiment of the instant invention, the tipping components are not needed. These tipping components instead are replaced with extra material in the head part of the shell ($\mathbf{10}_A$") the tail part of the shell ($\mathbf{10}_C$"), as exemplified in FIG. 4. The shell could be a laminated shell or a fused shell/interlining. The extra material in the ends of the shell ($\mathbf{10}_A$") and ($\mathbf{10}_C$") could then be folded and stitched, replacing the tipping.

The fusing of shell to interlining would typically be done to bulk material rather than to pre-cut pieces of material. In this manner, the spreading and fusing process is simplified, because whole bolts of cloth may be simply overlaid and aligned. This is much easier and simpler than aligning individual pre-cut components, such as a shell and interlining, for individual ties. Such fused material—which contains, for example, both shell and interlining through the entire piece of goods—can then be cut in the same manner and generally to the same size and shape that the shell has always been cut. The tipping material may now be smaller since it no longer needs to retain the interlining. The tipping may also be cut and stitched to the fused shell/interlining. The product is then turned right side out; this turning is also simplified without needing to worry about or address a "floating" interlining inside the shell and tipping.

Of course, fusing or lamination of smaller or even of pre-cut pieces of fabric still provides many of the advantages of using fused or laminated material in constructing neckties. Certainly the fusing of bulk goods before any cutting is done can maximize the number of steps saved by this process. Nevertheless, fusing of any of the parts that would otherwise need to be affixed to each other would still provide at least some of the same advantages in the construction of neckties. Similarly, fusing could allow, for example, a shell to be used without a separate, formal interlining. If the shell includes an extension to the normal shape of the shell, it could be used without a separate, formal tipping. Thus, a fused shell/interlining might be used without any tipping, while a laminated shell could be used without any separate interlining or tipping.

Another advantage of the use of fusing in neckties is that the fusing process eliminates fraying that might otherwise occur with certain materials or fabrics upon cutting. In this manner, materials or fabrics that were considered relatively unstable for constructing neckties can now be considered more readily and easily. Such fabrics might include, without limitation, linen and loosely woven fabrics.

The instant invention has also resulted in products that exhibit greater stretch and recovery properties than had been expected. Thus, fused products have the ability to be stretched or knotted without losing the ability to return to their original shape and size, and without deformations or other marking caused by manipulation of the product.

Part of the reluctance for using fusing in neckties may have been the anticipated potential for show-through or strike-through problems. Show-through describes the situation when the interlining pattern is inadvertently rendered visible through the finished product. Strike-through describes the situation when the fusing glue runs through the shell material, visibly marking or staining the shell fabric. These problems may have been especially anticipated with regard to neckties, since shell materials for ties tend to be lighter, thinner materials and fabrics than for most other clothing.

But strike-through and show-through have not been observed to be a significant problem with the instant invention. Products produced in this manner have been indistinguishable from prior art products viewed from any distance. Not unless the tie is carefully examined from the back can anything unusual or different be detected.

The present invention is particularly useful in producing pre-folded, or "clip-on" ties. This is because the material in such clip-on neckties does not need to demonstrate good recovery of shape and appearance, or to have the ability of being knotted and re-knotted time and again without affecting their appearance.

Fusible materials that could be fused or laminated onto a shell include, without restriction, non-woven, woven, composite, film, resin, or any other material that can be used as a laminate. Any fusible material fused or laminated onto the shell to serve the purpose of an interlining is considered, for purposes of this description, an interlining and shell fused or laminated together. Any lamination that involves only one ply of cloth material is considered a lamination of that cloth material. For example, if a shell is laminated with resin, it would be considered a laminated shell, without an interlining.

DESCRIPTION OF THE PREFERRED EMBODIMENT

Figure 4:
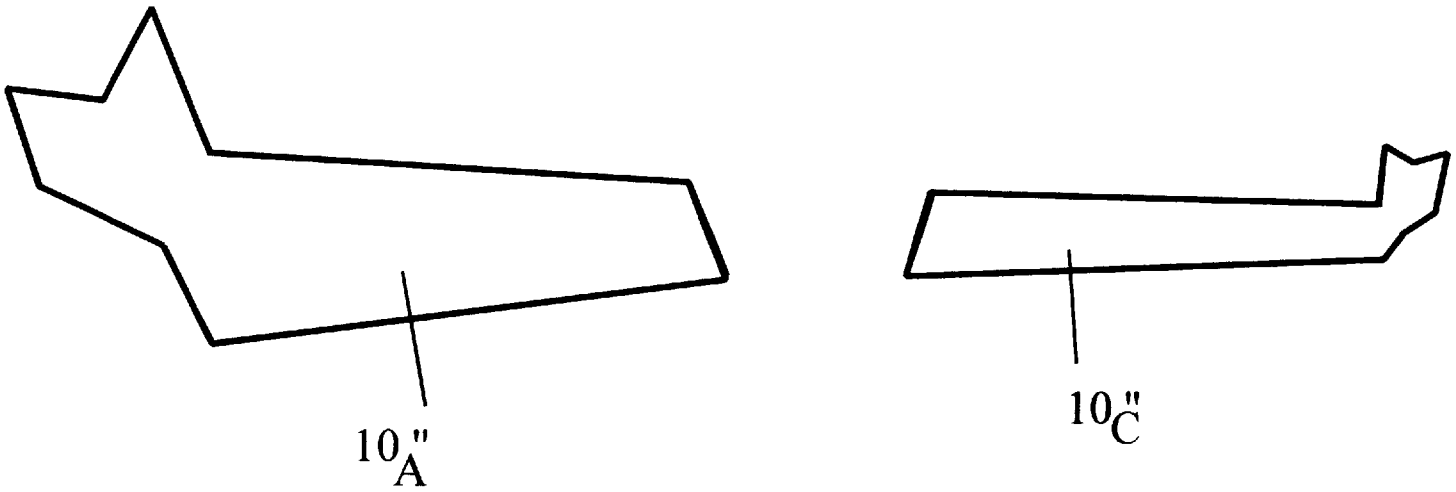
FIG. 4 is a view of the modified parts of the shell of a second necktie that embodies the instant invention, this time without a need for separate tipping.

Reference will now be made in detail to the present preferred embodiment of the invention, examples of which are illustrated in part in the accompanying FIGS. 3 and 4.

In general, the invention provides an advantage whenever components of neckties are fused or laminated rather than affixed or prepared in traditional manners. The particular nature or type of goods used for the components is discretionary, and depends mainly on the desired characteristics of the finished product rather than whether the instant invention is used.

However, the invention is deemed to be particularly advantageous when used in construction of neckties, and especially pre-folded neckties, composed of a shell, an interlining to be fused to the shell before spreading and cutting, and a tipping material attached to the shell/interlining after the materials are spread and cut.

Preferably the interlining is a single-ply non-woven material that is both widely and economically available. The interlining is fused to the shell before spreading and cutting, and a tipping component is then attached to the fused shell/interlining.

Most preferably the tie is a pre-folded tie, with a single-ply non-woven interlining. The interlining is fused to the shell before spreading and cutting, and a tipping component is then attached to the fused shell/interlining.

Any and all publications and patents mentioned in this specification are indicative of the level of skill of those skilled in the art to which this invention pertains. All publications and patents are herein incorporated by reference to the same extent as if each individual publication or patent was specifically and individually indicated to be incorporated by reference.

The invention now having been fully described, it will be apparent to those skilled in the art that many variations and modifications can be made thereto without departing from the spirit or scope of the appended claims.

What is claimed is:

1. A method of constructing a necktie, excluding simulated-knot neckties, having a shell component, an interlining component, and a tipping component, comprising: (a) fusing bulk shell material to bulk interlining material before the shell or interlining is spread and cut; (b) spreading and cutting the fused shell/interlining; and (c) affixing the tipping.

2. The method according to claim 1 wherein the necktie is pre-folded necktie.

3. The method according to claim 1 wherein the necktie is a standard necktie.

* * * * *